United States Patent [19]

Harper

[11] 4,403,368

[45] Sep. 13, 1983

[54] PAINT CAN SUPPORT FOR LADDERS

[76] Inventor: Orville R. Harper, 1410 6th Ave., Neptune, N.J. 07753

[21] Appl. No.: 347,573

[22] Filed: Feb. 10, 1982

[51] Int. Cl.[3] ..... B44D 3/14

[52] U.S. Cl. ..... 15/257 R; 248/210

[58] Field of Search ..... 15/104 R, 257 R; 211/71, 113, 126; 248/210, 211, 236

[56] References Cited

U.S. PATENT DOCUMENTS 3,895,772 7/1975 Ellingson ..... 248/210

*Primary Examiner*—Edward L. Roberts

*Attorney, Agent, or Firm*—Charles F. Gunderson

[57] ABSTRACT

A flat support panel is formed to fit between the sides of a ladder and to cover two adjacent rungs of the ladder. A trapezoidal opening is cut out of the center of the support panel between the two adjacent rungs, with a base having a width equal to the diameter of a pail of paint; a height equal to the height of the pail; and a top width less than the bottom width. When the flat support panel is hung from one rung of a ladder, extending over the next lower rung, the trapezoidal opening is positioned between the sides of the ladder, and the adjacent rungs. When a pail of paint is positioned within the trapezoidal opening it is held at an angle with respect to the support panel to be in a vertical plane when the ladder is at its normal, safe angle. A bail hook may be provided above the center of the trapezoidal opening to hold the handle of the pail of paint, which is held level and rigid for painting from the ladder.

6 Claims, 5 Drawing Figures

PAINT CAN SUPPORT FOR LADDERS

The problems of painting on a ladder are well known. The paint can must be supported or hung in some way or another as securely as possible; close to the ladder, to the wall being painted, and to the hand doing the painting. The most common device is a double hook, available commercially, but often bent from a coat hanger that fits over one of the rungs of the ladder and under the handle of the paint can.

This form of device leaves the paint can swinging, with a real possibility of spillage for a full can; an insecure and moveable opening to try to put the brush in; and an unsteady edge to wipe off the sides of the brush. This leads to the excess paint filling the rim and, as often, running down the sides of the paint can.

Other types of brackets extend outside the ladder, with some advantages of accessiblity, but still with the basic problem of an insecure, swingable paint can or pail. Still another device is seen in the U.S. Pat. No. 4,895,772 to Ellingson for a "Device for Supporting a Bucket on a Ladder". This hangs between two rungs of a ladder, but still holds the paint pail or bucket in a gimble-like mounting that is far from rigid.

It is therefore an object of this invention to provide a paint can support for ladders that holds a paint can rigid between two rungs of the ladder so that the paint can or pail will be level at the normal angle for mounting a ladder against a wall. It is a further object of this invention to provide a device that is simple, has few elements, and no moving parts. It is a further object of this invention to provide a device that holds a paint can in place with no swaying or motion with respect to the ladder or the painter. It is a further object of this invention to provide a device for holding paint pails that includes a means for clearing excess paint off a brush, to reduce drip, without the paint clogging the lip of the rim or running down the sides of the paint can.

SUMMARY OF THE INVENTION

A flat plate, slightly longer than the distance between adjacent rungs of a standard ladder, and slightly narrower than the distance between the sides of the ladder, is positioned between two adjacent rungs of a ladder. The top of the plate or support sheet has hooks extending backward to engage the upper one of the rungs, and the lower portion of the plate extends over the lower rung. The center portion of the device includes a trapezoidal opening with a narrower top portion and a wider bottom portion, so that when a paint pail is positioned within the opening its top extends further away from the plate than the bottom. A forwardly-projecting hook near the top of the plate, above the trapezoidal opening, holds the handle of the paint pail.

DETAILED DESCRIPTION OF THE DRAWINGS

Figure 1:
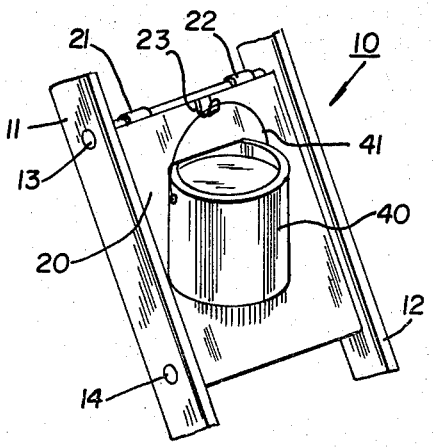
FIG. 1 shows an isometric view of the device in use.

Referring now more particularly to FIG. 1, an isometric view of a paint pail is shown mounted in a typical device on a ladder. The ladder 10 has sides 11 and 12, and rungs 13 and 14. The support sheet 20 of this species of the device has top hooks 21 and 22 and a handle hook 23. This can secure a handle such as 41 of a pail 40.

Figure 2:
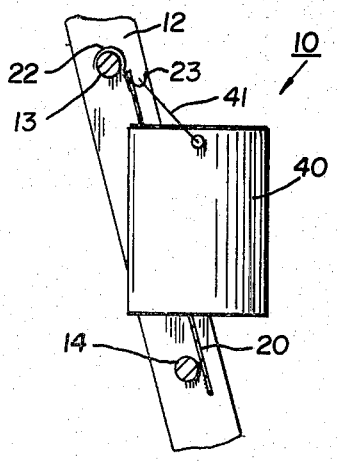
FIG. 2 shows a side view, partly in cross section, of the device in use.
Figure 3:
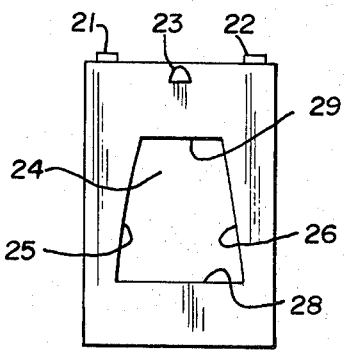
FIG. 3 shows a front view of the device.
Figure 4:
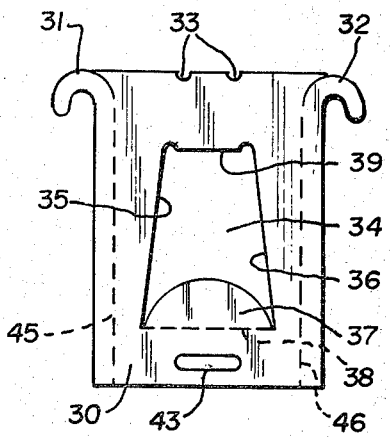
FIG. 4 shows a front view of another species of this device.

FIG. 2 shows a side view of the species of FIG. 1, partly in cross section, to illustrate the seating of the paint pail 40 within a trapazoidal opening that will be more clearly seen in FIGS. 3 and 4. Here, as in all of the figures, similar elements are similarly numbered. The far side 12 of the ladder, and the rungs 13 and 14 are seen along with the top hook 23. The edges of the trapezoidal opening, along with the handle 41, in the handle hook 23 support the pail.

FIG. 3 is a front view of the support sheet 20, without a pail, to more clearly show the trapezoidal opening or cutout 24. This opening has sides 25 and 26 sloping from a wide bottom edge 28 to a narrower top edge 29. The top hooks or hangers 21 and 22 are seen at the top of the sheet along with the handle hook or clip 23.

It can easily be seen that a pail can be supported, at a slight angle, as seen in FIG. 2, by the bottom and side edges of the cutout, and by the clip 23 for the handle. For certain sizes and shapes of paint pails, the fit may be more tight, and the pail held more securely by a slight outward curve of the sides 25 and 26, as seen in FIG. 3.

FIG. 4 shows a front view of another species of this device. Here the support 30 could be of cardboard, or the like, and scored or indented along the dotted lines 45 and 46, so that the sides can be folded down to form the hangers 31 and 32 to engage the upper rung of a ladder, as will be seen in FIG. 5.

The trapezoidal cutout 34 may be similar to 24, but here it includes a flap 37, that can fold back along another indented line 38. This may be formed to catch the back of the bottom lip of the pail, when it is inserted, to further lock it in place. The top edge 39, here, is shown with a projection that will catch inside the top lip of the open pail to further secure it, and more practically, will serve as a simple and effective ledge to wipe off the excess paint from the brush. With this configuration, the excess paint from every wipe of the brush will drip back into the pail, without filling the lip of the pail or dripping down the side of the pail, as is almost invariably the case when painting with only a standard pail and brush.

The top handle hook, in this species is replaced by notches 33 that should be deep enough to secure the handle. An additional carrying handle 43 is suggested in the lower, clear area of the support sheet. This could, of course be in any free area in the sides or top.

Figure 5:
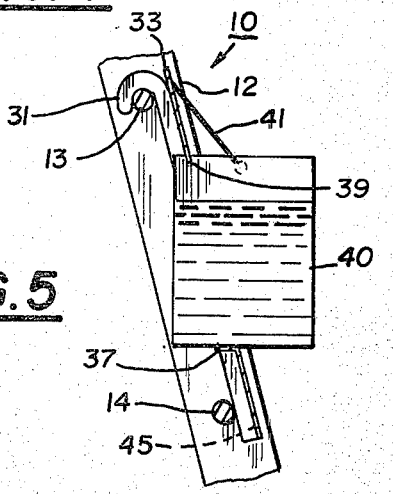
FIG. 5 shows a side view, partly in cross section, of the species of FIG. 4 in use.

FIG. 5 shows a side view of the species of FIG. 4 in use on the ladder 10, holding the pail of paint 40. This is partly in cross section to illustrate the various element in use, and the top edge, or ledge 39 forming a brush wiper conveniently located and ready for use. The handle 41 is seen in the slot 33, while the flap 37 engages the lip of the bottom of the pail.

In practice, the support sheet can be of almost any flat, semirigid material, such as aluminum, plywood, hardboard, or, as in the species of FIG. 4, cardboard. It must be strong enough to support the various hooks, and, of course, the weight of the pail of paint. The more durable the material, the longer the useful-life expectancy. However, the cost of materials, and the cost of manufacture, and other considerations might favor a simple stamped and folded structure as seen in FIGS. 4 and 5 to accommodate a specific pail and to last for a season or a single job.

The size and shape of the trapezoidal cutout is variable, and will depend on the size, diameter, and heigth of the pail, as well as the angle that will be optimum for most ladders. For example, if a safe ladder angle is seventy five degrees, the angle of the pail with respect to the support sheet could be between twelve and fifteen degrees. A typical cutout might have a bottom edge of six and three quarters inches, and a top edge of five inches spaced seven and three quarters above the bottom.

If the bottom edge comes to or just past the center of the pail, and the pail is tilted slightly in, the pail should balance within the opening without additional support for the handle. However, prudence would suggest the use of the bail hook or handle hook 23. The slight outward curve of the sides 25 and 26, as suggested in FIG. 3, would also fit a pail more deeply in the trapezoidal cutout.

The various hooks and hangers can be of any size and shape that can engage the appropriate rungs and handle; that can be securely attached to the support sheet; and that can support the necessary weight.

Various additional hooks, clips, pegs, or the like, can, of course, be positioned along the support sheet to hold extra, special-purpose brushes, putty knives, or other accessories for the job in hand. As noted earlier, the cut-out handle 43 could be at the top or sides or bottom, since the device would probably be carried, or hung up, without the pail of paint. Additional holes for hanging on a nail or peg board could be included in obvious locations on the support sheet.

I claim:

1. A paint pail holder for a ladder having a given spacing between the sides of said ladder, and a given spacing between the rungs of said ladder; said paint pail holder comprising a rigid support sheet; said support sheet being narrower than said given spacing between the sides of said ladder, and being longer than said given spacing between the rungs of said ladder; at least one hook extending from the upper rear of said support sheet to hook over one of the rungs of said ladder; a trapezoidal section cut out of the central portion of said support sheet to fit between said sides and two adjacent rungs of said ladder; said trapezoidal section having a base portion equal in length to the diameter of a given pail of paint; said trapezoidal section having a heigth equal to the height of said given pail of paint; and said trapezoidal section having a top portion of less length than that of said base portion; to accomodate and hold said given pail, rigid within said trapezoidal section, at an angle with respect to said support sheet, in a horizontal plane.

2. A paint pail holder for a ladder as in claim 1 wherein said top portion of said trapezoidal section includes a dropped central section to extend within said given pail for wiping excess paint off a paint brush to drip within said given paint pail.

3. A paint pail holder for a ladder as in claim 1 having a secondary hook extending from the front of said support sheet, above the top portion of said trapezoidal section to secure the handle of said given paint pail.

4. A paint pail holder for a ladder as in claim 1 wherein the sides of said trapezoidal section are curved outwardly to accomodate the curvature of certain variations of said given paint pail.

5. A paint pail holder for a ladder as in claim 1 having at least two hooks extending from opposing sides of the upper rear of said support sheet to hook over said one of said rungs of said ladder.

6. A paint pail holder for a ladder as in claim 5 wherein said support sheet comprises a panel of cardboard with opposing sides formed to provide said two hooks and folded back to provide said given spaceing between said sides of said ladder and to extend said hooks from opposing sides of said upper rear of said support sheet.

* * * * *